United States Patent [19]

Carolus et al.

[11] 4,300,141

[45] Nov. 10, 1981

[54] ROTARY SUPPORT STRUCTURE FOR A POWER ANTENNA CABLE STORAGE DRUM

[75] Inventors: David T. Carolus; Ralph W. Edwards, both of Dayton, Ohio

[73] Assignee: General Motors Corporation, Detroit, Mich.

[21] Appl. No.: 93,376

[22] Filed: Nov. 13, 1979

[51] Int. Cl.[3] ..... H01Q 1/10

[52] U.S. Cl. ..... 343/903

[58] Field of Search ..... 343/901, 903, 711, 715, 343/723, 900, 877

[56] References Cited

U.S. PATENT DOCUMENTS 4,209,792 6/1980 Carolus et al. ..... 343/903

*Primary Examiner*—Eli Lieberman

*Attorney, Agent, or Firm*—Donald F. Scherer

[57] ABSTRACT

A power driven rotatable antenna cable storage drum has a driven worm gear formed circumferentially about one end of its periphery. The drum is supported for rotation on two axially aligned equal diameter post members. One of the post members is integral with the housing and the other post member is integral with the cover. The cover post member is spaced from and radially aligned with the driven worm gear.

3 Claims, 2 Drawing Figures

ROTARY SUPPORT STRUCTURE FOR A POWER ANTENNA CABLE STORAGE DRUM

This invention relates to rotatable drum support structures and more particularly to rotatable support structures for a power antenna cable storage drum disposed within a closing housing.

It is an object of this invention to provide a power antenna with an improved cable storage drum support structure wherein rotational support for the drum is provided by axially aligned posts integral with the housing and cover, respectively.

Another object of this invention is to provide an improved cable storage drum support structure for use in a power antenna wherein rotational support for the drum is provided by two axially aligned, equal diameter posts integral with the housing and cover, respectively, and wherein the cover post is radially aligned and axially concentric with a driven worm gear formed integrally with a portion of the drum.

Figure 1:
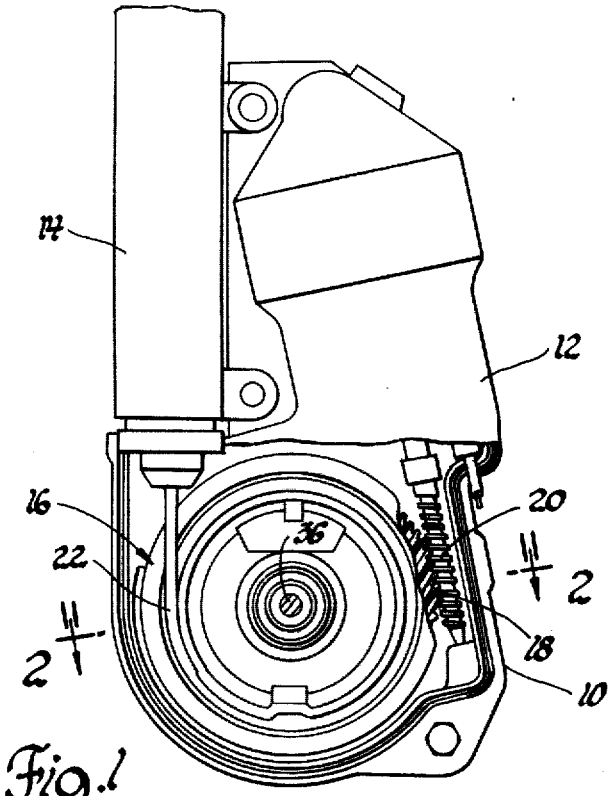
Figure 2:
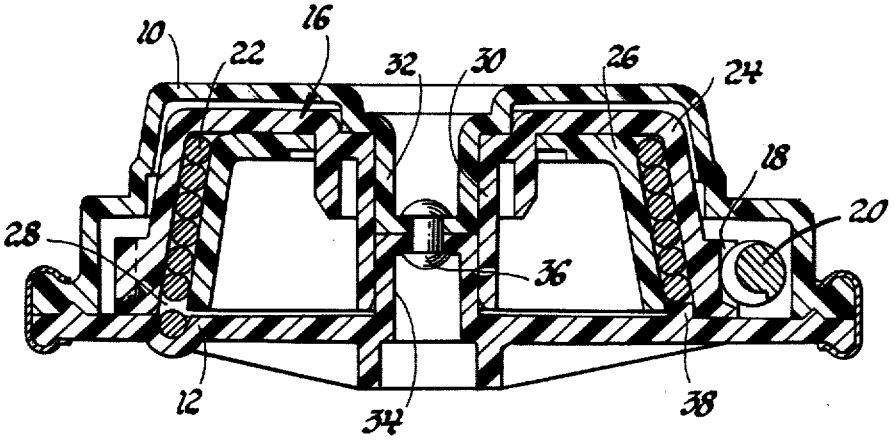

These and other objects and advantages of the present invention will be more apparent from the following description and drawings wherein:

FIG. 1 is a side elevational view of a power antenna and drive mechanism with a portion of the cover removed; and FIG. 2 is a sectional view taken along line 2—2 of FIG. 1.

Referring to the drawing, wherein like characters represent the same or corresponding parts throughout the several views, there is seen in FIG. 1 a power antenna having a housing 10, a cover 12, a mast jacket 14 and a cable storage drum structure 16.

The drum 16 has a worm gear 18 formed integrally with the outer diameter thereof; which worm gear 18 is driven by a worm shaft 20. The worm shaft 20 is driven by a conventional electric motor, not shown, which is housed between the housing 10 and the cover 12.

A cable 22 is stored in the drum structure 16 and has one end thereof connected to a telescoping antenna, not shown, which is housed in a conventional manner within the mast jacket 14.

The drum structure 16 is preferably constructed in accordance with the teaching of U.S. Pat. No. 4,181,268, issued Jan. 1, 1980. The drum structure 16 has an outer drum member 24 and an inner drum member 26 which are secured together in a manner taught by the above-mentioned U.S. Pat. No. 4,181,268, so as to provide frustoconical storage chamber 28 in which the cable 22 is stored during retraction of the antenna and from which it is extended during extension of the antenna. The outer drum member 24 has the worm gear 18 integrally formed therein and also has integrally formed therewith a cylindrical bearing portion 30 which is rotatably mounted on a pair of right circular cylinder posts 32 and 34, respectively, which are formed integrally with the housing 10 and cover 12, respectively. The posts 32 and 34 are secured together by a fastener 36 which is preferably a rivet.

As best seen in FIG. 2, the driven worm gear 18 is radially spaced from the post 34 and is also axially concentric with the post 34 such that any radial forces imposed on the driven worm gear 18 by the drive worm 20 will be supported by the post 34. There is also seen in FIG. 2 a support rib 38 which is constructed in accordance with the teaching of U.S. Ser. No. 47,068, filed June 11, 1979 and assigned to the assignee of the present application. The support rib 38 does absorb some of the radial load of worm gear 18, however, the majority of the load will be supported by post 34.

It has been found that utilizing a single post 32 formed integrally with the housing 10 does not provide a sufficiently rigid support in applications wherein high ambient temperatures can be achieved. Due to the cantilever support inherent with the single post member formed on the housing 10, the post member will deflect slightly to permit some separation between the gear teeth on the worm 20 and the worm gear 18. By utilizing the present invention of a post formed in the cover which is aligned with and fastened to a post formed in the housing, a more rigid support structure is accomplished. The post 34 formed in the cover 12 significantly reduces the cantilever support effect found in prior art devices and when cooperating with the support post 32 contributes greatly to the rigidity of the rotary support structure.

The embodiments of the invention in which an exclusive property or privilege is claimed are defined as follows:

1. An improvement in power antenna drive support mechanisms wherein a cable storage drum having a worm gear formed integrally therewith is rotatably supported on a post in a housing cavity which is closed by a cover; said improvement comprising, a right circular cylindrical support member formed integrally with said cover and axially aligned with said post; and fastening means securing said post and said right circular cylindrical support member together, said cable storage drum being supported for rotation on both said post and said right circular cylindrical support member with the worm gear being spaced from and radially aligned with said right circular cylindrical support member.

2. An improvement in power antenna drive support mechanisms wherein a cable storage drum having a worm gear formed integrally therewith is rotatably supported on a housing post in a housing cavity which is closed by a cover; said improvement comprising, a cover post member formed integrally with said cover axially aligned with said housing post and having the same diameter as said housing post; and fastening means securing said posts together, said cable storage drum being supported for rotation on both said posts with the worm gear being axially concentric with and radially aligned with said cover post member.

3. An antenna cable storage drum assembly comprising, a housing member of generally cup shape defining an open face and having an inwardly extending centrally disposed hollow cylindrical post defining a generally annular space and terminating in a web;

a cover member assembled with said housing member to span the open face thereof to form a cavity and having a centrally disposed hollow post aligned with the first mentioned post and terminating in a web seated against said first mentioned web;

a cable storage drum disposed in said cavity and rotatably journaled on the outer cylindrical surfaces of said aligned posts;

and a fastener extending through the webs and of the type securable by access through the hollow posts.

* * * * *